US005664626A

United States Patent [19]

Watts, III

[11] Patent Number: 5,664,626

[45] Date of Patent: Sep. 9, 1997

[54] MECHANICAL PLUG DEVICE

[76] Inventor: William F. Watts, III, 6570 SW. 56th St., Davie, Fla. 33314

[21] Appl. No.: 466,901

[22] Filed: Jun. 6, 1995

[51] Int. Cl.[6] ..... E21B 33/03

[52] U.S. Cl. ..... 166/75.13; 166/92.1; 166/93.1; 166/97.1; 285/901; 138/89

[58] Field of Search ..... 166/75.13, 92.1, 166/93.1, 94.1, 97.1; 285/901; 138/89

[56] References Cited

U.S. PATENT DOCUMENTS

| | | | |
|---|---|---|---|
| D. 317,270 | 6/1991 | Hensley . | |
| D. 317,271 | 6/1991 | Hensley . | |
| 2,760,579 | 8/1956 | Kabakoff | 166/75.13 X |
| 4,411,312 | 10/1983 | English | 166/75.13 |
| 4,580,629 | 4/1986 | Jaworowsky | 166/97.1 X |
| 4,848,458 | 7/1989 | Holdsworth et al. | 166/92 |
| 4,881,597 | 11/1989 | Hensley | 166/92 |
| 4,942,923 | 7/1990 | Geeting | 166/250 |
| 4,971,149 | 11/1990 | Roberts | 160/92 |
| 5,295,535 | 3/1994 | Boles et al. | 166/81 |
| 5,323,854 | 6/1994 | Dursley | 166/75.13 X |
| 5,348,085 | 9/1994 | Benson | 166/92 |
| 5,380,125 | 1/1995 | Croy | 166/267 X |
| 5,437,309 | 8/1995 | Timmons | 166/192 X |
| 5,509,757 | 4/1996 | Croy | 166/267 X |

OTHER PUBLICATIONS

MWSS Inc., Monitoring Well "J" Plug, 1 p (Model Nos. J-102P & J-104P).

*Primary Examiner*—Roger J. Schoeppel
*Attorney, Agent, or Firm*—Myers Liniak & Berenato

[57] ABSTRACT

A mechanical plug device for an environmental monitoring well is disclosed for sealing the exposed top end of a well casing in order to prevent pollutants from entering the monitoring well. The plug is lockable to prevent unauthorized access to the monitoring well. A valve assembly is attached to the plug so as to allow a user to selectively fluidly communicate with a sampling port and the interior of the monitoring well, thereby permitting fluid samples to be extracted through the plug without removing the plug from the well and without exposing the well interior to the outside atmosphere.

16 Claims, 4 Drawing Sheets

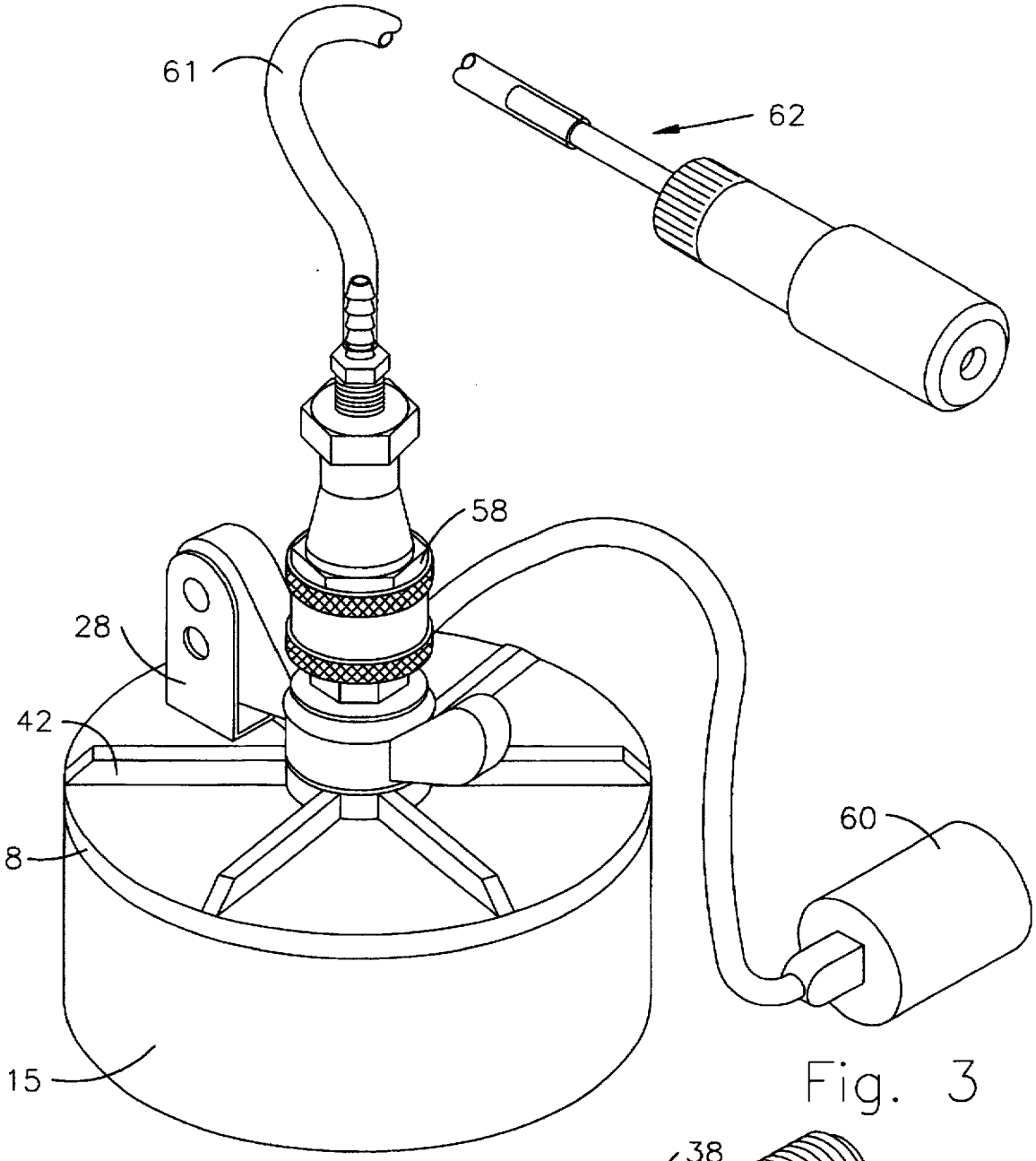
Fig. 2
Fig. 3
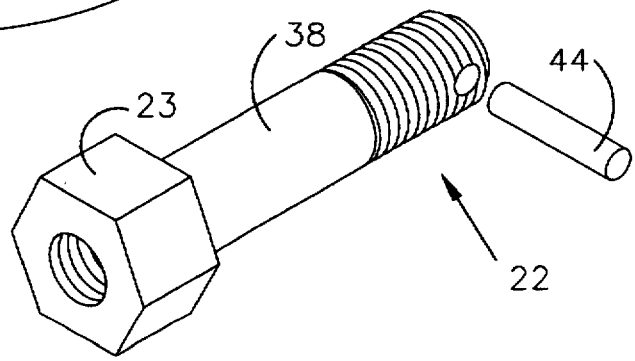

MECHANICAL PLUG DEVICE

MECHANICAL PLUG DEVICE

This invention relates generally to a mechanical plug device for an environmental monitoring well and, more particularly, to a well monitor plug device for sealing the exposed top of a well casing which is both environmentally safe and capable of being locked to prevent pollutants from entering the monitoring well. Further, the well monitor plug device allows fluids to be extracted from the well interior for sampling without the user having to remove the plug from the well.

BACKGROUND OF THE INVENTION

In response to ecological concerns, the Federal Environmental Protection Agency (EPA) has developed regulations regarding leakage from underground storage tanks. To assist in the detection of leakage, observation wells and monitoring wells are often installed near such tanks. An observation well, known in the art, is a well located within an area around a tank which was excavated during installation of the tank. A monitoring well on the other hand is known in the art as a well outside of the tank excavation area (some of which extend below the water table). Observation and monitoring wells typically have similar constructions. The term "monitoring well" is used herein to refer to both observation wells and monitoring wells, and also to refer to other known wells for monitoring waste areas. Furthermore, hereinafter fluids, vapors, liquids, and gases are collectively referred to as fluids.

An often encountered problem in the art is presented when leaking or leeching processes occur at waste area sites. In such circumstances, pollutants or toxic materials soak into the earth thereby contaminating the immediate vicinity and posing a potential threat. It is beneficial in such situations to have a well present for monitoring the waste area so as to quickly detect such leaks.

The underlying purpose of many monitoring wells is to protect the quality of the underground water table often used as a drinking water supply or other similar purposes. Strategic placement of a number of monitoring wells around storage, waste area, processing, or manufacturing sites containing pollutants or toxic materials, and subsequent periodic sampling of fluids from the monitoring wells, gives an early indication of underground water supply contamination in the immediate vicinity of the potential threat. Samples taken from the monitoring wells on a periodic and systematic basis are tested for their fluid quality. If a leak or leeching process is occurring or has occurred at the storage, waste, manufacturing, or processing site, the effects of pollutant intrusion into the underground water supply or into the earth are discovered in their initial stages by testing the well samples. A key to the success of such a monitoring system lies in a program of systematic and continuous recovery of fluid samples from the monitoring wells and in maintaining the integrity of such monitoring wells from external events and/or substances which may potentially cause erroneous or biased readings from fluid quality analysis done on the recovered samples.

U.S. Pat. No. 4,942,923 to Geeting discloses an apparatus for isolating a testing zone in a bore hole screen casing. The isolated test zone is defined between lower and upper plug members with a fluid carrying tube connected to the upper plug member for accessing and sampling fluid within the test zone. Unfortunately, the apparatus of the '923 patent suffers from at least the following problems. Firstly, the '923 apparatus is an internal device disposed inside of the conduit (i.e. well casing) itself. In other words, it is not located at the end or top of a conduit, but instead is disposed interior the conduit at a predetermined depth at which it is desirable to access and sample fluid. Internal devices such as that disclosed in the '923 patent are limited to particular depths, difficult to access, and requires an undesirably large amount of labor to install. Additionally, the '923 patent apparatus is non-locking increasing susceptability to tampering. In view of this, it is clear that there exists a need in the art for a sampling plug which may be placed on a conduit end (e.g. the top of a well casing) so that it is both easy to access when it is desired to take samples, and simple to install.

Another problem with the device of the '923 patent is that the device itself (not including the sampling tube attached to it) does not provide as effective a seal as would be desired in view of the fact that the bore in the upper plug member remains open at all times. In view of this, it is apparent that there exists a need in the art for a sampling plug which, when not in use, functions as a complete fluid seal in of itself so as to keep fluid from entering or leaving the conduit or well interior when samples are not being obtained.

U.S. Pat. No. 5,348,085 discloses a mechanical plug device for sealing a well casing. The plug device of the '085 patent includes an adjustable and tamper resistant sealing structure which includes a turning member and cooperating locking member which permits access to a sampling aperture. The monitor plug of the '085 patent may be secured to the top of a well casing and permits sampling access without requiring the removal of the plug. When sampling is desired by way of the plug of the '085 patent, a latch member must first be pivoted to an upward position, and then a threaded plug must be removed from the sampling conduit or port in order to provide sampling access to the well interior. Unfortunately, this process required for sampling is both time consuming and difficult. Furthermore, the closing of the sampling port by way of the threaded plug is not as effective as would otherwise be desired in view of the fact that proper closing of the conduit requires both the plug being tightly screwed into the conduit opening and the threads of the mating connection being in "good shape". Additionally, the well interior is undesirably exposed to the outer atmosphere upon removal of this threshold plug. This exposure to the atmosphere contaminates the integrity of the well interior thus hurting the sampling process. In view of this, it is clear that there exists a need in the art for a well monitor plug device which allows for simpler and more efficient sampling of the well interior without having to remove the plug itself.

It is a purpose of this invention to fulfill the above-described needs in the art, as well other needs in the art which will become apparent to the skilled artisan once given the following disclosure.

SUMMARY OF THE INVENTION

Generally speaking, this invention fulfills the above-described needs in the art by providing a monitoring plug device adapted to be sealingly connected to the top end of a well casing, the plug device comprising:

- a first plate having a first aperture defined therein and a flange adapted to fit over the top end of the well casing;
- a second plate adapted to fit into the well casing, the second plate having a second aperture defined therein;
- an annular expandable sealing member sandwiched between the first and second plates so that when the first and second plates are forced toward one another, the sealing member expands into sealing contact with the interior of the well casing;

an elongated member having an axially extending sampling aperture defined therein, the elongated member adapted to be positioned within the first and second apertures so that the sampling aperture is in fluid communication with the interior of the well casing; and a valve connected to a top end of the elongated member, the valve for selectively permitting fluid samples to be taken from the interior of the well casing by way of the sampling aperture without having to remove the plug device from the top end of the well casing.

This invention further fulfills the above-described needs in the art by providing a sampling plug for permitting fluid samples to be taken from the interior of a well casing without having to remove the plug, the sampling plug comprising:

a sealing cap adapted to the sealingly affixed to an end of the well casing so as to prevent fluid from entering or leaving the interior of the well casing, the cap including opposing plates with an expandable sealing member disposed therebetween, wherein the sealing cap has an aperture defined therein for allowing an elongated sampling member to be disposed within the cap; and wherein the elongated sampling member has an axially extending sampling aperture defined throughout its length for permitting fluid samples to be taken from the interior of the casing without removing the cap.

In certain preferred embodiments of this invention, the sampling plug further includes a valve connected to the elongated sampling member, the valve adapted to be positioned exterior the well casing so as to allow fluid samples to be taken only when the valve is in an open position.

In still further preferred embodiments of this invention, the sampling plug further includes means for attaching a coupler to the valve for the purpose of opening the valve and allowing fluid samples to be taken from the interior of the well casing, the valve being in a closed position except when the coupler is attached thereto.

This invention will now be described with reference to certain embodiments thereof as illustrated in the following drawings.

IN THE DRAWINGS

FIG.2 is a perspective view of the mechanical plug of the instant invention when installed at the top end of a well casing.

FIG. 3 is a perspective view of an alternate embodiment of the bolt member of the instant invention, the bolt member defining an axially extending sampling aperture therein.

BRIEF DESCRIPTION OF CERTAIN PREFERRED EMBODIMENTS

Figure 1:
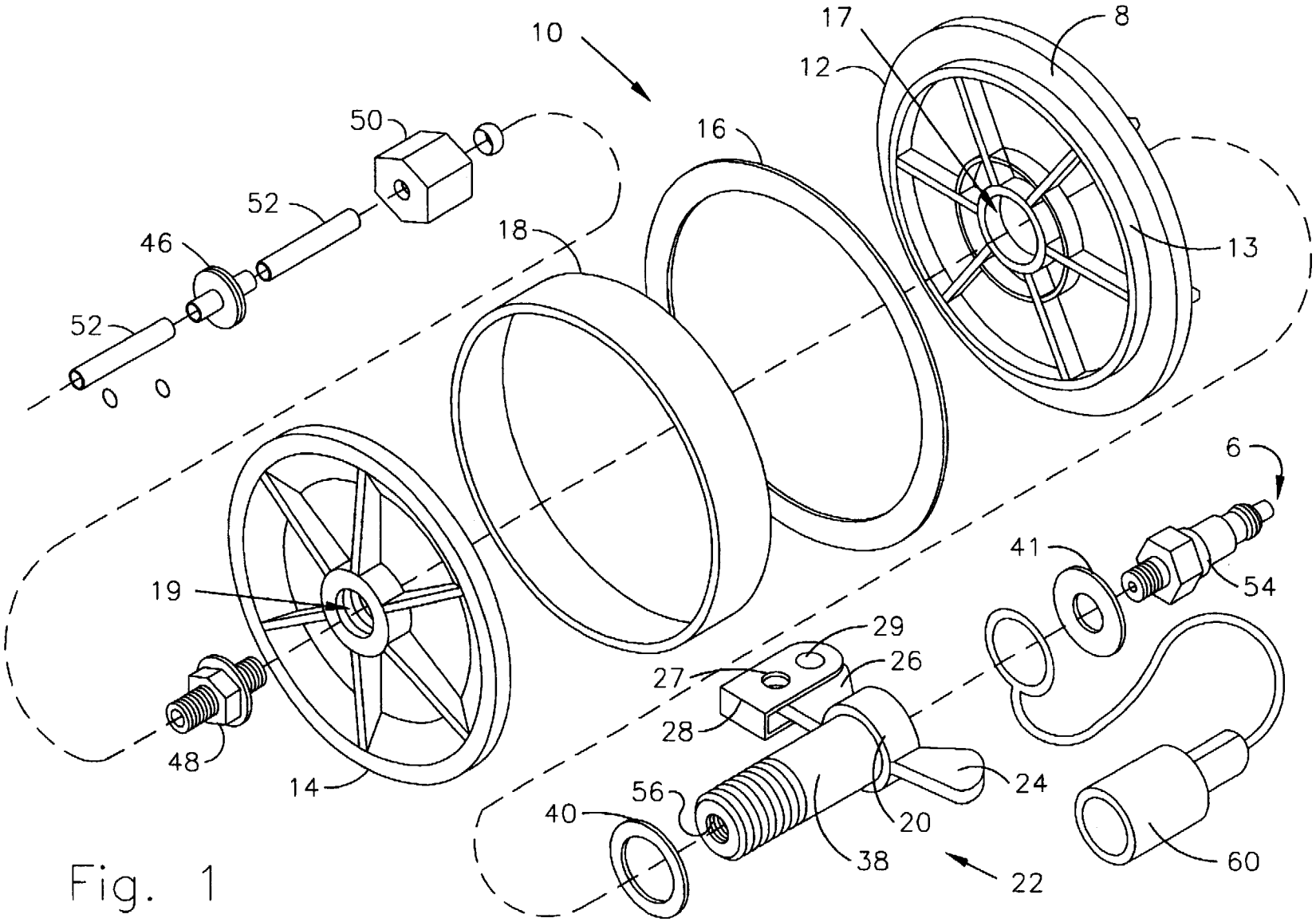
FIG. 1 is an exploded perspective view of the mechanical plug of the instant invention.

Referring now to the drawings, and in particular FIG. 1, the mechanical plug of the present invention is shown generally at 10, comprising upper or top plate member 12 and lower or bottom plate member 14, between which O-rings 16 and 18 are positioned. Top plate 12 has a downwardly extending annular flange 13 that preferably does not exceed the inside diameter of the upper end of well casing 15 and a radially outward extending flange 8 which allows plug 10 to fit over the end of well casing 15. O-rings 16 and 18 are used to provide a sealed connection between top plate member 12 and bottom plate member 14. O-rings 16 and 18 are fluid impervious gaskets having a circular or annular cross-section. It is to be understood that the sealing O-rings 16 and 18 may be formed of various suitable materials, including Buna Nitril, rubber, neoprene, nylon, and Teflon®.

As shown in FIG. 1, hollow bolt member 22 having a substantially T-shape includes head or cap portion 20 defined in part by ear member 24 and opposing ear member 26. Ears 24 and 26 of head 20 combine with cylindrical bolt body 38 to define the above-referenced T-shape. An axially extending sampling aperture is defined within hollow bolt 22, the aperture or passageway extending from port 56 to the top of head 20 (i.e. all the way through bolt 38). Pivotable locking hasp 28 is mounted to ear member 26 by way of pivot pin 29 for the purpose of enabling plug 10 to be locked onto the top end of well casing 15. Ear member 26 further includes locking aperture 27 defined therein for allowing a locking member (e.g. padlock) or the like to pass through hasp 28 and ear 26 in order to lock plug 10 on casing 15.

Extending downwardly from bolt head 20 is hollow threaded cylinder or bolt body 38 which is received and engaged by threaded aperture 19 defined in bottom plate member 14. When head 20 of bolt 22 is tightened down against the exterior or top surface of plate 12, opposing plates 12 and 14 are forced together due to the threads of aperture 19 thereby expanding O-ring 18 radially outward against the casing 15 inner diameter to create a fluid seal. Hollow cylinder 38 defines sampling port 56 at the lower end of the sampling aperture defined throughout the length of bolt 38. Low friction washer 40 is provided between bolt 22 and top plate 12 for ease of operation purposes.

As seen in FIG. 1, valve assembly 54, preferably in the form of a one way valve, is attached to head 20 of bolt member 22 by way of a brass close nipple and fluidly communicates with sampling port 56 which fluidly communicates with the well interior 21 itself. Low friction washer 41 is provided between bolt 22 and valve assembly 54 for ease of operation purposes to hold dust cover 60 in place.

As seen in FIG. 2, self-sealing, quick-disconnect coupler assembly 58 sealingly engages valve assembly 54, thereby allowing well monitor plug 10 to adapt quickly to most any vapor analyzer or peristaltic pump (not shown) by fluidly connecting a probe and tube assembly 62 to the vapor analyzer or peristaltic pump for the purpose of removing samples from well interior 21. Further, dust cover 60 may be attached to valve 54 to cover the valve assembly when coupler 58 is not attached to the valve assembly 54.

Figure 5:
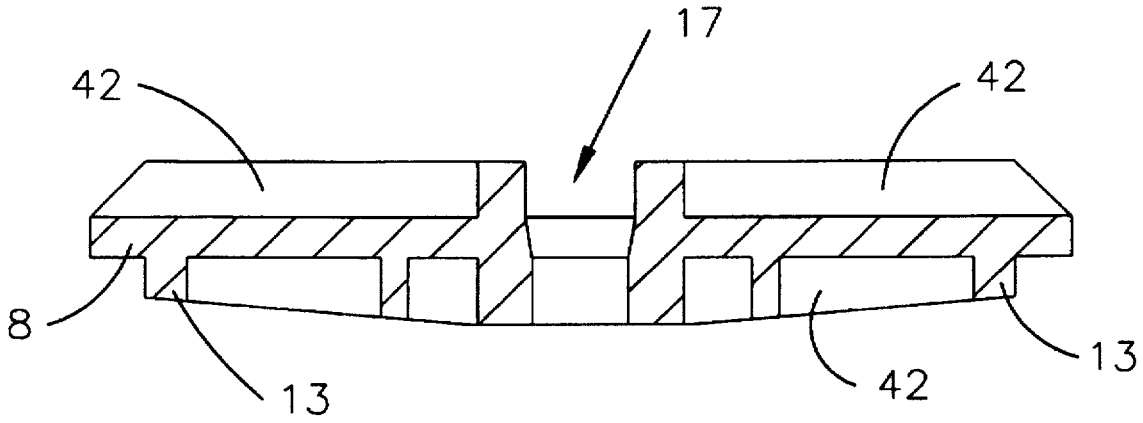
FIG. 5 is a cross-sectional view of flange 8 including stop members 42 on either side thereof.

Referring now to FIGS. 1–2 and 5, the upper face of solid top plate 12 is shown to have six radially extending equidistantly spaced stop members 42 defined thereon. Each stop member 42 has a specified height and width which cooperates with locking hasp 28. The height of each stop member 42 is such that locking hasp 28 may not pass over the stop member when bolt member 22 is rotated by grasping and rotating the ear members 24 and 26 and locking hasp 28 is in the down position. Head 20 along with ears 24 and 26 are, of course, affixed to bolt 22 for rotation therewith. A padlock or the like may be placed through locking aperture 27 and locking hasp 28 in order to keep hasp 28 in the down position and thereby limit access to the monitor plug.

Referring now to FIG. 3, an alternate embodiment of bolt member 22 is shown wherein the hollow bolt member comprises a hexagonal head 23 (instead of ears 24 and 26) to prevent unauthorized access to the well, in that a deep socket or the like would be necessary to pass over valve assembly 54 to loosen bolt member 22 inclusive of head 23.

In a vapor sampling embodiment, stop pin 44 (see FIG. 3) extends through the bottom of threaded cylinder 38 to prevent the dismemberment of the well monitor plug 10 during operation should bolt member 22 be inadvertently loosened further than necessary. On the other hand, in a water sampling embodiment, stop pin 44 is removed, and a fluid sampling tube 52 is connected to threaded cylinder 38. Sampling tube 52 is connected to bolt 22 by a compression coupling assembly including hollow coupling member 48 which is threaded on each side and is threadably engaged with both port 56 of threaded bolt 38, and a gnarled coupling member 50 with a threaded aperture defined therethrough. The compression coupling assembly further includes one way valve 46 that fluidly connects sampling conduit 52 with bolt sampling port or passageway 56 thereby allowing the pump attached to probe and tube assembly 62 to remove gas samples from the well interior. Assembly 62 is used for gas or vapor sampling while tube 61 is affixed to a pump for liquid sampling.

Well monitor plug 10 of the instant invention is structured to sealingly secure the top end of well casing 15 and to provide a simple sampling access without requiring the removal of the plug by way of at least valve 54, hollow bolt 22 and tube 52. Plug 10 is a unitary structure and is preferably molded of thermoplastic elements. The plug 10 includes upper and lower plates 12 and 14, between which an expandable sealing O-ring 18 is positioned. Valve member 54 is attached to the top of the plug and fluidly communicates with sampling port 56 which allows the user to take a well fluid sample without removing plug 10 from well casing 15.

In accordance with certain embodiments of this invention, plug 10 is designed so that fluid samples may be periodically taken from the well interior without removing plug 10. In normal use when samples are not being taken, dust cover 60 is placed over the top of valve 54 for protective purposes. Dust cover 60 may be, for example, Model No. FD45-1040-02, available from Aeroquip Industrial, Maumee, Ohio.

When it is desired to take a sample from the well interior, dust cap 60 is first removed from the top of valve 54 so as to expose it. Then, coupling 58 is pressed onto the top 6 of valve 54 for the purpose of opening valve 54 and permitting fluid samples to be taken from well interior 21. When coupler 58 is placed on valve 54, the coupler functions to both open valve 54 and lock thereonto. Valve 54 remains in an open position while coupler 58 is attached thereto, but closes whenever coupler 58 is removed from the valve. Coupler 58 may be a brass industrial interchange coupling which provides corrosion resistance and uses a Push-pull™ latch mechanism according to certain embodiments of this invention. Coupling 58 may be, for example, Model No. FD45-1101-02-02 also available from Aeroquip. Valve 54 may be, for example, Model No. FD45-1086-02-02 available from Aeroquip.

In effect, valve 54 acts as the male portion while coupler 58 functions as a female portion when the valve and coupler are attached to one another. When attached, dual interface O-rings (not shown) in coupler 58 provide redundant sealing. The Push-pull™ ball latch design of coupler 58 allows quick and easy connection and disconnection of hose or conduit line 61 to valve 54 by way of the coupler. Valve 54 includes a self-sealing poppet valve which provides both high and low pressure sealing from both sides when coupler 58 is not affixed to valve 54.

Figure 4:
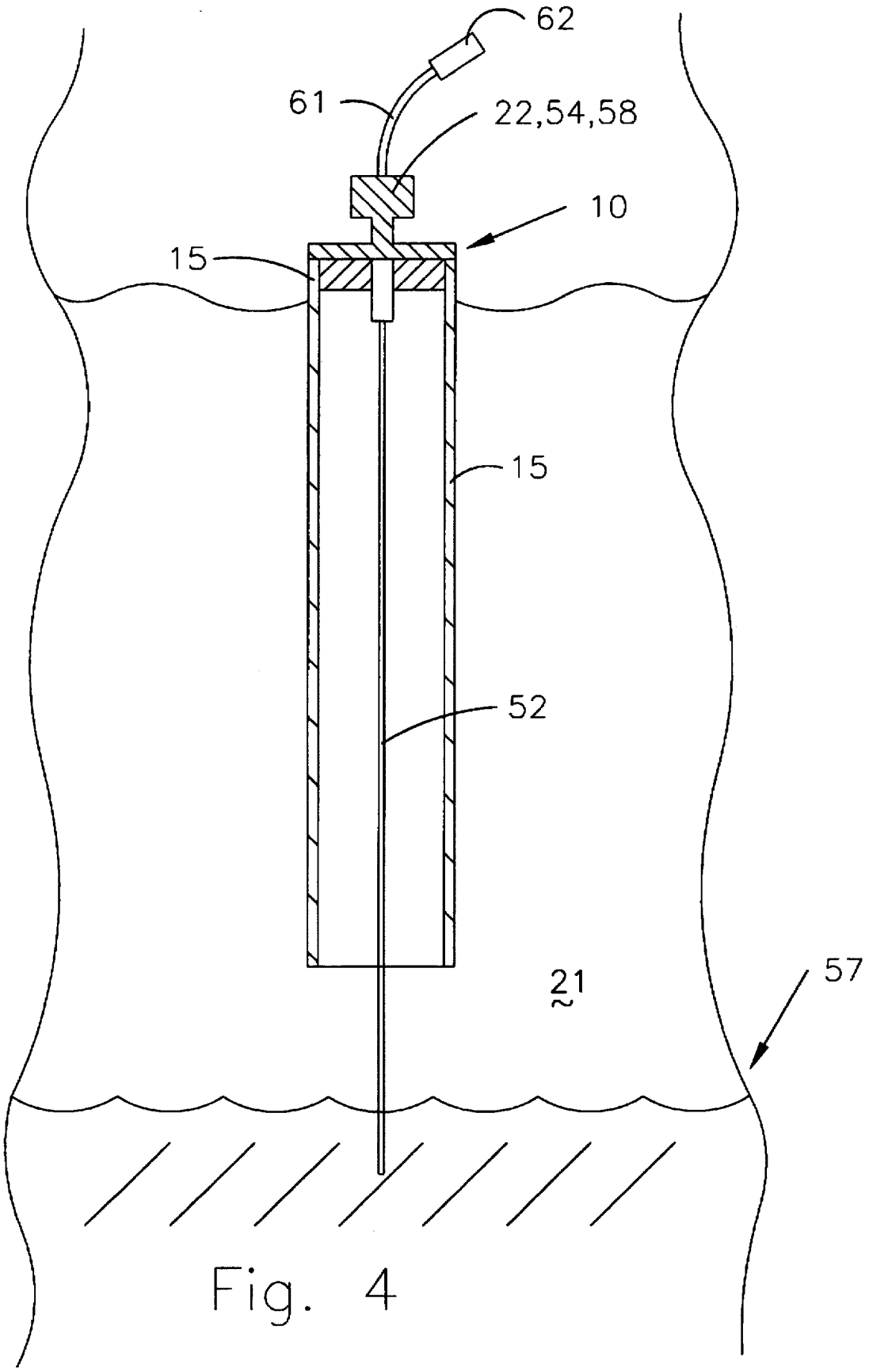
FIG. 4 is a side partial cross-sectional view of the FIG. 1–3 plug being used in a water table well monitoring environment.

FIG. 4 is a side partial cross-sectional view of plug 10 positioned on the top end of well casing 15 in accordance with a liquid sampling embodiment of this invention. Plug 10 in FIG. 4 is not shown in detail for purposes of simplicity. Flange 8 of top plate 12 permits plug 10 to be attached to the top end of well casing 15 so that lower plate 14 and expandable sealing member 18 are disposed within casing 15 while simultaneously top plate member 12 is disposed exterior well casing 15 on the top end thereof.

As shown, sampling conduit 52 is affixed to elongated bolt member 38 so as to be in fluid communication with valve 54 by way of the axially extending sampling aperture defined in bolt 38. Sampling conduit 52 as shown in FIG. 4 extends all the way down to water table 57 so as to permit liquid samples to be taken from the water table in accordance with this embodiment. Thus, when a pump or vacuum is affixed to plug 10 by way of hose 61 and coupler 58, liquid samples may be withdrawn from the water table through conduit 52, valve 46, bolt 38, valve 54, coupling 58, and hose 61. Optional check valve 46 prevents insertion of fluid or gas into the well interior.

According to gas sampling embodiments of this invention, sampling conduit 52 is either not attached to plug 10 or extends only a small distance downward into well casing 15 thereby allowing gas samples (not liquid) to be removed from well interior 21. Assembly 62 is used to removed such gas samples. Well casing 15 may be, for example, schedule 40 PVC, stainless steel pipe, or the like.

A typical installation and operation of plug 10 will now be described. Plug 10 is first assembled by positioning expandable sealing member 18 in between top plate 12 and lower plate 14. Plates 12 and 14 are provided with apertures 17 and 19 defined therewithin so as to permit hollow bolt 38 to be fed into and located within the plug. Bolt 38 is fed into aperture 17 and aperture 19 with the exterior threads of bolt 38 engaging with corresponding interior threads defined in aperture 19. When bolt 38 is tightened down upon the top surface of plate 12, opposing plates 12 and 14 are forced toward one another as a result of the threaded engagement between the bolt threads and the aperture 19 threads. When opposing plates 12 and 14 are forced together, sealing member 18 is in turn forced to expand outwardly into fluid sealing engagement with the inner diameter of well casing 15.

Valve 54 is threaded affixed to the top end of bolt 38 and includes a poppet (not shown) which remains closed in a sealing manner unless coupler 58 is thereafter attached to valve 54. Thus, during the normal sealing function of plug 10, valve 54 is the upward extent of plug 10 and remains closed so as to prevent fluid from entering or leaving the well interior.

When it is desired to take a fluid sample from the well interior, a user need simply attach coupler 58, hose 61 and assembly 62 (for gas sampling) to the top end of valve 54. The attaching of coupler 58 to valve 54 opens the valve so as to permit fluid communication between the well interior and assembly 62 by way of hose 61 without exposing the well interior to the outside atmosphere. A typical pump or vacuum is affixed to assembly 61 in order to draw fluid samples through bolt 38, valve 54, hose 61 and assembly 62 so that they may be analyzed and tested for contaminants and the like.

Once given the above disclosure, many other features, modifications, and improvements will become apparent to the skilled artisan. Such other features, modifications, and improvements are therefore considered to be a part of this invention, the scope of which is determined by the following claims.

I claim:

1. A monitoring plug device adapted to be sealingly connected to the top end of a well casing, the plug device comprising:

a first plate having a first aperture defined therein and a flange adapted to fit over the top end of the well casing;

a second plate adapted to fit into the well casing, said second plate having a second aperture defined in;

an annular expandable sealing member sandwiched between said first and second plates so that when said first and second plates are forced toward one another, the sealing member expands into sealing contact with the interior of the well casing;

an elongated member having an axially extending sampling aperture defined therethrough, said elongated member adapted to be positioned within said first and second apertures so that said sampling aperture is in fluid communication with the interior of the well casing; and a valve connected to a top end of said elongated member, said valve for selectively permitting fluid samples to be taken from the interior of the well casing by way of said sampling aperture without having to remove the plug device from the top end of the well casing thereby permitting sampling without exposing the well interior to the outside atmosphere.

2. The plug device as recited in claim 1, wherein said elongated member includes means for preventing dismemberment of said plug device disposed proximate the bottom end of said elongated member.

3. The plug device as recited in claim 2, wherein said means for preventing is a stop pin which extends through said elongated member bottom end.

4. The plug device as recited in claim 1, wherein said elongated member includes a horizontally extending member connected to a head portion thereof.

5. The plug device as recited in claim 4, wherein said horizontally extending member comprises a first outwardly extending ear member and a second outwardly extending ear member.

6. The plug device as recited in claim 5, wherein said first outwardly extending ear member includes an aperture disposed therethrough.

7. The plug device as recited in claim 6, further comprising a locking hasp pivotally mounted to said first outwardly extending ear member.

8. The plug device as recited in claim 7, further comprising a plurality of radially extending stop members positioned on an upper surface of said first plate, said stop members preventing rotation of said elongated member when said locking hasp is pivoted to a downwardly extending position.

9. The plug device as recited in claim 1, further comprising means for connecting a fluid sampling tube to said elongated member within the casing in order to permit liquid sampling.

10. A sampling plug for permitting fluid samples to be taken from the interior of a well casing without having to remove the plug, the sampling plug comprising:

a sealing cap adapted to be sealingly affixed to an end of the well casing so as to prevent fluid from entering or leaving the interior of the well casing, said cap including opposing plates with an expandable sealing member disposed therebetween, wherein said sealing cap has an aperture defined therein for allowing an elongated rigid sampling member to be disposed within said cap; and wherein said elongated sampling member has an axially extending sampling aperture defined throughout its length for permitting fluid samples to be taken from the interior of the casing without removing said cap.

11. The sampling plug of claim 10, wherein said elongated sampling member includes exterior threads and is threadedly engaged with the aperture defined in one of said plates.

12. The sampling plug of claim 10, further including a valve connected to said elongated sampling member, said valve adapted to be positioned exterior the well casing so as to allow fluid samples to be taken only when said valve is in an open position.

13. The sampling plug of claim 12, wherein said valve is threadedly engaged with said elongated sampling member.

14. The sampling plug of claim 13, further comprising a tube adapted to be connected to said elongated sampling member within the interior of the well casing, the tube for allowing liquid samples to be taken from the interior of the well casing.

15. The sampling plug of claim 13, wherein said elongated sampling member includes a head portion adapted to be pressed against a surface of one of said plates so that said expandable sealing member is caused to expand radially between said plates into sealing contact with the inner diameter of the well casing.

16. The sampling plug of claim 12, further comprising means for attaching a coupler to said valve for the purpose of opening said valve and allowing fluid samples to be taken from the interior of the well casing, said valve being in a closed position except when said coupler is attached thereto.

* * * * *